US008327943B2

(12) United States Patent
Borak et al.

(10) Patent No.: US 8,327,943 B2
(45) Date of Patent: Dec. 11, 2012

(54) WELLHEAD ISOLATION PROTECTION SLEEVE

(75) Inventors: Eugene A. Borak, Tomball, TX (US); Alfredo Olvera, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 277 days.

(21) Appl. No.: 12/617,430

(22) Filed: Nov. 12, 2009

(65) Prior Publication Data

US 2011/0108275 A1 May 12, 2011

(51) Int. Cl.
*E21B 7/12* (2006.01)
*E21B 33/03* (2006.01)

(52) U.S. Cl. ..... 166/368; 166/379; 166/90.1

(58) Field of Classification Search ..... 166/368, 166/379, 305.1, 90.1
See application file for complete search history.

(56) References Cited

U.S. PATENT DOCUMENTS

| | | | | |
|---|---|---|---|---|
| 5,176,218 | A * | 1/1993 | Singer et al. | 166/208 |
| 5,819,851 | A | 10/1998 | Dallas | |
| 5,975,211 | A | 11/1999 | Harris | |
| 6,516,861 | B2 | 2/2003 | Allen | |
| 6,810,954 | B2 | 11/2004 | Garrett et al. | |
| 6,920,925 | B2 | 7/2005 | Duhn et al. | |
| 7,040,412 | B2 | 5/2006 | DeBerry | |
| 7,308,934 | B2 * | 12/2007 | Swagerty et al. | 166/177.5 |
| 7,614,448 | B2 | 11/2009 | Swagerty et al. | |
| 2003/0205385 | A1 | 11/2003 | Duhn et al. | |
| 2006/0011347 | A1 | 1/2006 | Reimert | |
| 2006/0171786 | A1 | 8/2006 | Delves et al. | |
| 2006/0175572 | A1 | 8/2006 | Syvertsen | |
| 2006/0177273 | A1 | 8/2006 | Bonnemaire et al. | |
| 2006/0177274 | A1 | 8/2006 | O'Sullivan | |
| 2006/0177275 | A1 | 8/2006 | Allen et al. | |
| 2006/0177276 | A1 | 8/2006 | Stassen et al. | |
| 2006/0180018 | A1 | 8/2006 | Kabir et al. | |
| 2006/0180208 | A1 | 8/2006 | Walpole | |
| 2006/0180317 | A1 | 8/2006 | Sieben | |
| 2006/0185841 | A1 | 8/2006 | Swagerty et al. | |
| 2006/0188188 | A1 | 8/2006 | Abrahamian | |
| 2006/0191461 | A1 | 8/2006 | Chow | |
| 2006/0191680 | A1 | 8/2006 | Nelson | |
| 2006/0196673 | A1 | 9/2006 | Pallini, Jr. et al. | |
| 2006/0196677 | A1 | 9/2006 | McGuire et al. | |
| 2006/0196695 | A1 | 9/2006 | Giroux et al. | |
| 2006/0201679 | A1 | 9/2006 | Williams | |
| 2006/0201681 | A1 | 9/2006 | Reynolds | |
| 2006/0201682 | A1 | 9/2006 | Reynolds | |
| 2006/0201683 | A1 | 9/2006 | Reynolds | |
| 2006/0204340 | A1 | 9/2006 | Leenaars | |
| 2006/0210362 | A1 | 9/2006 | Wybro et al. | |
| 2006/0213840 | A1 | 9/2006 | Stacy et al. | |
| 2006/0219411 | A1 | 10/2006 | Moksvold | |
| 2006/0219412 | A1 | 10/2006 | Yater | |
| 2006/0225890 | A1 | 10/2006 | Ray | |
| 2006/0231248 | A1 | 10/2006 | Ford | |
| 2006/0231263 | A1 | 10/2006 | Boyce et al. | |
| 2006/0231264 | A1 | 10/2006 | Boyce et al. | |
| 2006/0231265 | A1 | 10/2006 | Martin | |
| 2006/0231266 | A1 | 10/2006 | Rodrigues et al. | |
| 2006/0235573 | A1 | 10/2006 | Guion | |
| 2007/0079990 | A1 * | 4/2007 | Borak | 175/57 |

* cited by examiner

*Primary Examiner* — Shane Bomar
*Assistant Examiner* — Catherine Loikith
(74) *Attorney, Agent, or Firm* — Bracewell & Giuliani LLP

(57) ABSTRACT

An isolation sleeve extends from an adapter into the bore of a tubing head to isolate high pressure frac fluid from the body of the tubing head. The isolation sleeve may be installed by a running tool that can screw the sleeve onto a packoff bushing located within the tubing head. The running tool can also retrieve the isolation sleeve by unscrewing it from the packoff bushing.

16 Claims, 7 Drawing Sheets

WELLHEAD ISOLATION PROTECTION SLEEVE

FIELD OF THE INVENTION

This invention relates in general to protecting a wellhead from high pressure and abrasive fluids imposed during a well fracturing operation.

BACKGROUND OF THE INVENTION

One type of treatment for an oil or gas well is referred to as well fracturing or a well "frac." The operator connects an adapter to the upper end of a wellhead member such as a tubing head and pumps a liquid at a very high pressure down the well to create fractures in the earth formation. The operator also disburses beads or other proppant material in the fracturing fluid to enter the cracks to keep them open after the high pressure is removed. This type of operation is particularly useful for earth formations that have low permeability but adequate porosity and contain hydrocarbons, as the hydrocarbons can flow more easily through the fractures created in the earth formation.

The pressure employed during the frac operation may be many times the natural earth formation pressure that ordinarily would exist. For example, the operator might pump the fluid at a pressure of 8,000 to 9,000 psi. The normal pressure that might exist in the wellhead might be only a few hundred to a few thousand psi. Because of this, the body of the wellhead and its associated valves typically may be rated to a pressure that is much lower than what is desired for the frac operation, such as 5,000 psi. While this is sufficient to contain the normal well formation pressures, it is not enough for the fluid pressure used to fracture the earth formation. Thus, the wellhead and associated valves may be damaged during frac operations.

Moreover, because of the proppant material contained in the frac fluid, the frac fluid can be very abrasive and damaging to parts of the wellhead. To allow the operator to use a pressure greater than the rated capacity of the wellhead seals (including the various valves associated with the wellhead) and to protect against erosion resulting from the frac fluid being pumped at high pressure and volume into the well, the operator may employ an isolation sleeve to isolate these sensitive portions of the wellhead from the frac fluid. An isolation sleeve seals between an adapter above the wellhead and the casing or tubing extending into the well. The sleeve isolates the high pressure, abrasive fracturing fluid from those portions of the wellhead that are most susceptible to damage from the high pressures and abrasive fluids used in well fracturing operations. A variety of designs exists and has been proposed in the prior art. While some are successful, improvements are desired.

SUMMARY OF THE INVENTION

An isolation sleeve is carried by a running tool or an adapter assembly for insertion into the bore of a wellhead or tubing head. The wellhead is the surface termination of a wellbore and typically includes a casing head for installing casing hangers during the well construction phase and (when the well will be produced through production tubing) a tubing head mounted atop the casing head for hanging the production tubing for the production phase of the well. The casing in a well is cemented in place in the hole that is drilled. The fluids from the well may be produced through the casing or through production tubing that runs inside the casing from the wellhead to the downhole formation from which the fluids are being produced.

The isolation sleeve may be configured to be installed and retrieved from the wellhead by a running/retrieval tool. The tool can be lowered through a double studded adapter connected to the tubing head and frac valve if installed. The tool can rotate the isolation sleeve in either a clockwise or counterclockwise direction to retrieve or install the isolation sleeve by threading or unthreading it with a packoff bushing located within the tubing head. The threaded engagement between the isolation sleeve and packoff bushing maintains the isolation sleeve within the tubing head during fracturing operations. The sleeve advantageously isolates the high pressure, abrasive fracturing fluid from those portions of the wellhead that are most susceptible to damage from the high pressures and abrasive fluids used in well fracturing operations. Further, the sleeve prevents this damage through a simplified installation and retrieval design that utilizes a threaded engagement between the isolation sleeve and the packoff bushing within the tubing head.

DETAILED DESCRIPTION OF THE INVENTION

Figure 1:
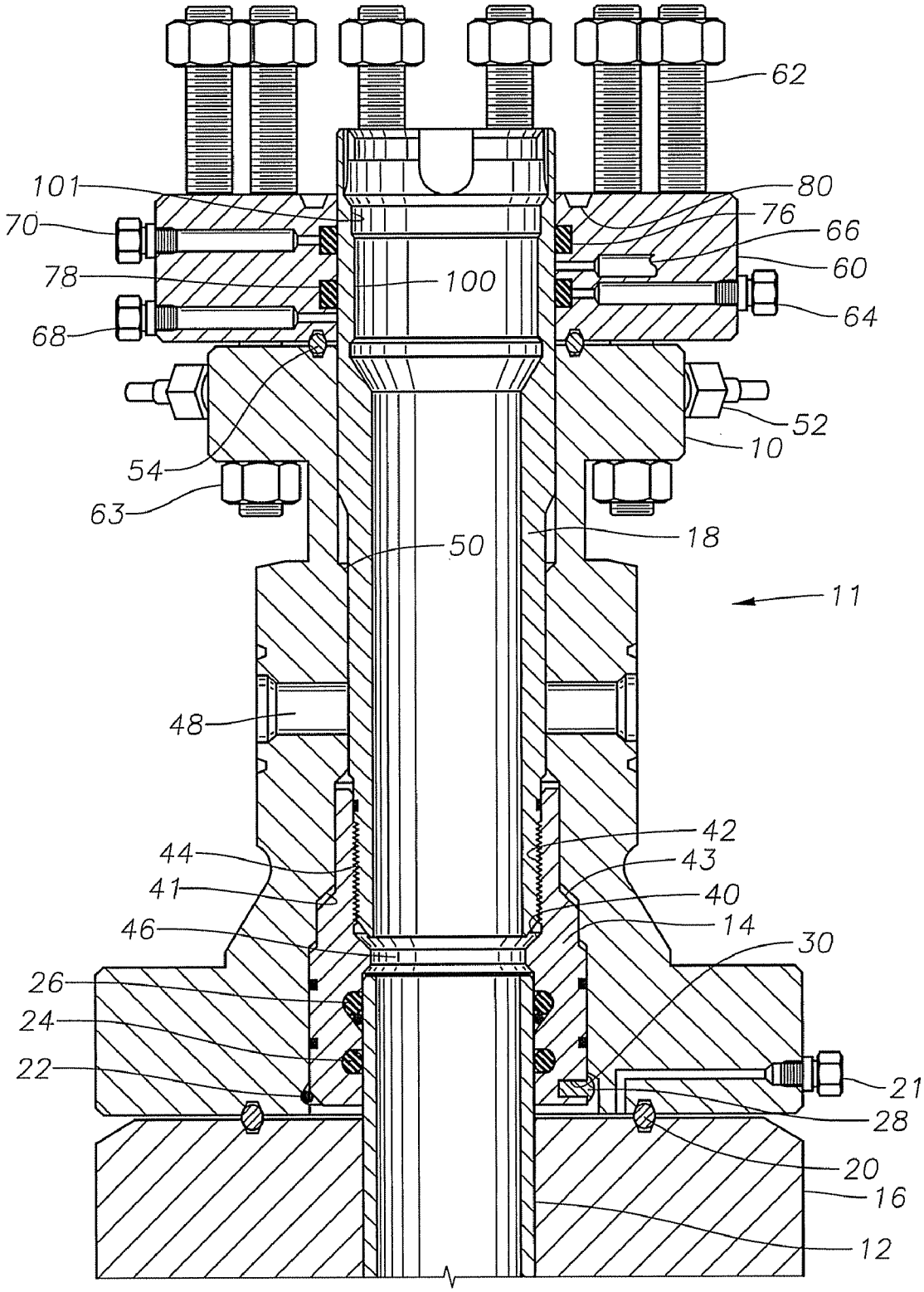
FIG. 1 is a sectional view illustrating a well fracturing assembly including an isolation sleeve connected a tubing head for a frac operation, the well fracturing assembly being constructed in accordance with one embodiment of the invention.

FIG. 1 shows an embodiment of a wellhead frac assembly 11 used in a frac operation. The wellhead or tubing head 10 may be rated for a working pressure of 5000 psi and has a bore extending vertically through it (the lower portion of the wellhead is not shown). In this embodiment, the lower end of the tubing head 10 sealingly connects to a stub of production casing 12 via a packoff bushing 14 located within the tubing head 10. The production casing 12 may protrude from a casing head 16 that can support the tubing head 10. A gasket 20 provides a seal between the tubing head 10 and the casing head 16 and potential leaks at the gasket 20 can be detected through a test port 21 on the tubing head 10 in communication with the annular space interior to the gasket 20. In this embodiment, the packoff bushing 14 has a profile that corresponds to an interior portion of the tubing head 10. The packoff bushing 14 can be locked in place within the tubing head by an annular snap ring 22 and sealed against the production casing 12 with an annular o-ring seal 24. An annular o-ring seal 26 with anti-extrusion ring can be installed on the low pressure side of the o-ring seal 24 to prevent elastomer extrusion into a clearance gap between the production casing 12 and the packoff bushing 14.

An isolation sleeve 18, which will be described in more detail below, is installed within the bore of the tubing head 10 to protect the tubing head 10 from the high pressure and abrasive fluids imposed during a well fracturing operation. The pressure during fracturing operations can be significantly higher than the rating of the wellhead 10 and associated components such as valves. Thus, isolation sleeve 18 and packoff bushing 14 are rated for pressures above 5000 psi normal working pressure. An isolation sleeve 18 and packoff bushing for 15,000 psi is also feasible. An end of isolation sleeve 18 threadingly engages the packoff bushing 14. In this embodiment, an anti-rotation key 28 located on the lower end of packoff bushing 14 interferes with a slot 30 formed in tubing head 10 to prevent the packoff bushing 14 from rotating during threading or unthreading of the isolation sleeve 18. In this embodiment, the packoff bushing 14 has a tapered shoulder 40 that can function as a stop for the isolation sleeve 18 as the isolation sleeve 18 is threaded into the inward facing threaded profile 42 of the packoff bushing 14 bore. Further, a downward facing shoulder 41 located on the wellhead member 10 interferes with an upward facing shoulder 43 located on the packoff bushing 14 to limit the upward movement of the packoff bushing 14 within the wellhead member 10. The threaded profile 42 of the packoff bushing 14 corresponds to a threaded outer surface 44 formed on the lower end of the isolation sleeve 18. The engagement between the threaded bore 42 of the packoff bushing 14 and the threaded profile 44 of the isolation sleeve 18 maintains the isolation sleeve 18 in place during fracturing operations. The tapered shoulder 40 prevents the lower end of the isolation sleeve 18 from coming into contact with the top of the production casing 12 to thereby create a gap 46 between the two well components.

Continuing to refer to FIG. 1, in this embodiment tubing head 10 can have one or more production outlets 48 located at a point above production casing 12 and extending laterally from the tubing head 10 for the flow of well fluid during production. Alternatively, outlets 48 could be used as instrumentation ports or outlets for leak detection. Further, tubing head 10 can have a tapered shoulder 50 formed inside the bore of tubing head 10 that can support a tubing hanger (not shown) if desired. Such a tubing hanger could be held in place within tubing head 10 by lockdown screws 52.

A gasket 54 provides a seal at the interface between the tubing head 10 and an annular double-studded adapter (DSA) 60 having a bore diameter that can accommodate the outer diameter of the isolation sleeve 18. A test port 68 can be provided to detect potential leaks at the gasket 54. A set of threaded studs 62 secures to threaded holes of the DSA 60 and protrudes upward and down from DSA 60. The lower ends of studs 62 extends through holes in an external flange of tubing head 10 and secure DSA 60 to tubing head 10 with nuts 63. The upper ends of studs 62 extend above DSA 60 to allow for connection to additional equipment or wellhead components. Injection ports 64, 70 extend from the interior bore of the DSA 60 to the exterior of the DSA 60 to allow activation of seals 76, 78 by injecting fluid pressure. Seals 76, 78 provide a seal between the bore of the DSA 60 and the outer surface of the isolation sleeve 18. Test port 66 leads to between seals 76, 78 and can be used to detect potential leaks at the seals 76, 78. In addition, the DSA 60 can have an annular gasket groove 80 if additional equipment is connected to the DSA 60.

Figure 2:
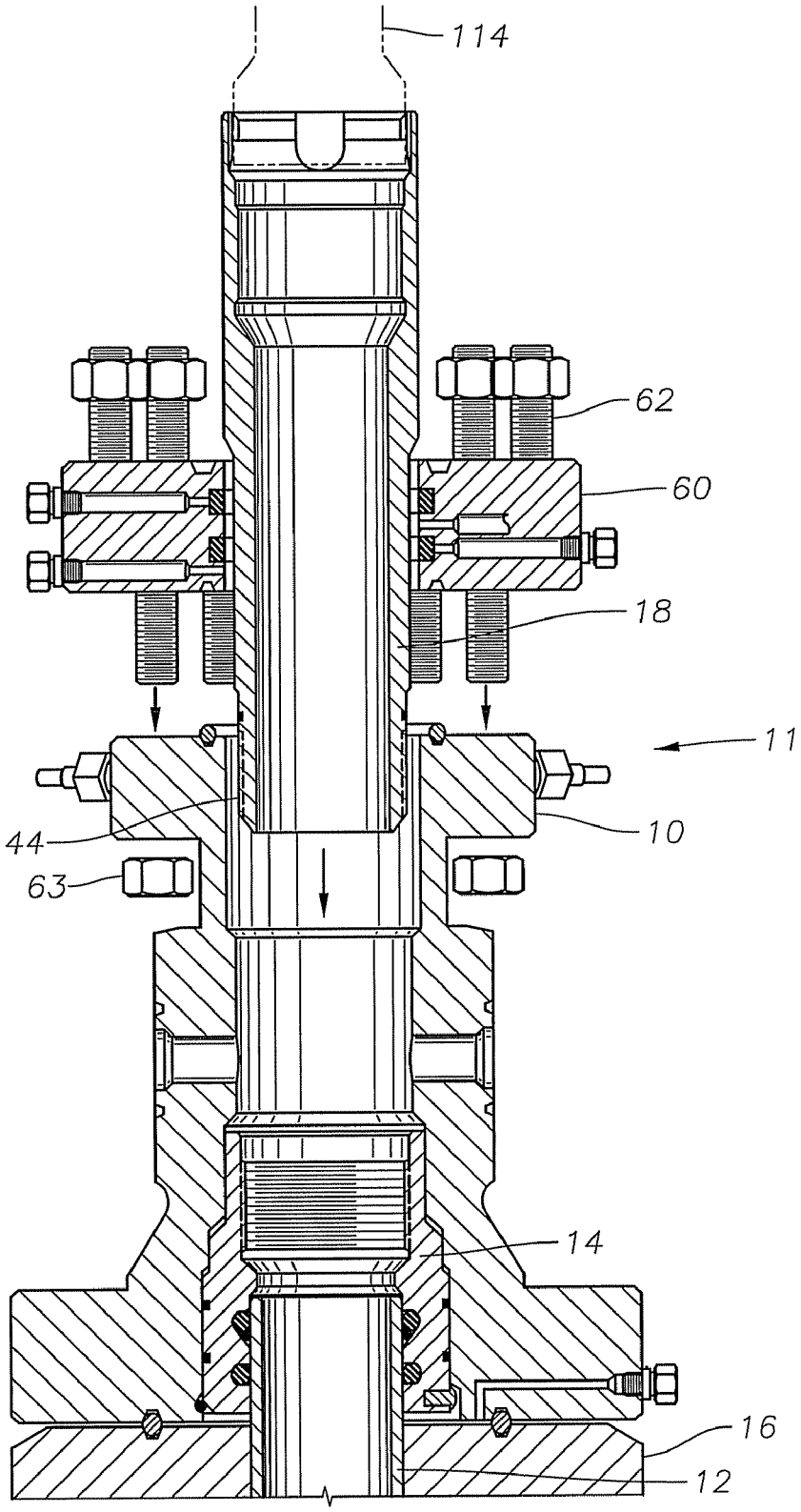
FIG. 2 is a partially exploded sectional view of a portion of the assembly in FIG. 1 showing the isolation sleeve in a pre-installed position, in accordance with one embodiment of the invention.

FIG. 2 shows a partially exploded sectional view of a portion of the frac assembly 11 in FIG. 1. During installation of the frac assembly 11, the packoff bushing 14 in this embodiment is installed within the corresponding profile located at the lower end of the tubing head 10. The stub of production casing 12 is prepared as required and the tubing head 10 and packoff bushing 14 are installed over the production casing 12 such that the stub of production casing 12 is received by the lower portion of the packoff bushing 14. The casing head 16 connection can also be made up at this point. The DSA 60 in this embodiment can then be connected to the top end of the tubing head 10 via the set of studs 62 located on the DSA 60. The stud sets 62 are received by bolt holes on a flange of the tubing head 10, then secured by nuts 63. The isolation sleeve 18 can be lowered through the bores of the DSA 60 and the tubing head 10, and threaded into the packoff bushing 14 within the tubing head 10. The threaded outer surface 44 of the isolation sleeve 18 preferably has a left handed thread.

Figure 3:
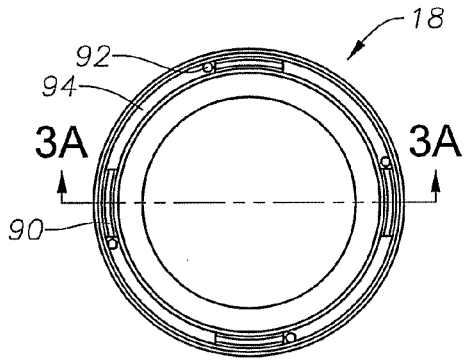
FIG. 3 is a top view of an embodiment of an isolation sleeve, in accordance with one embodiment of the invention.
Figure 3A:
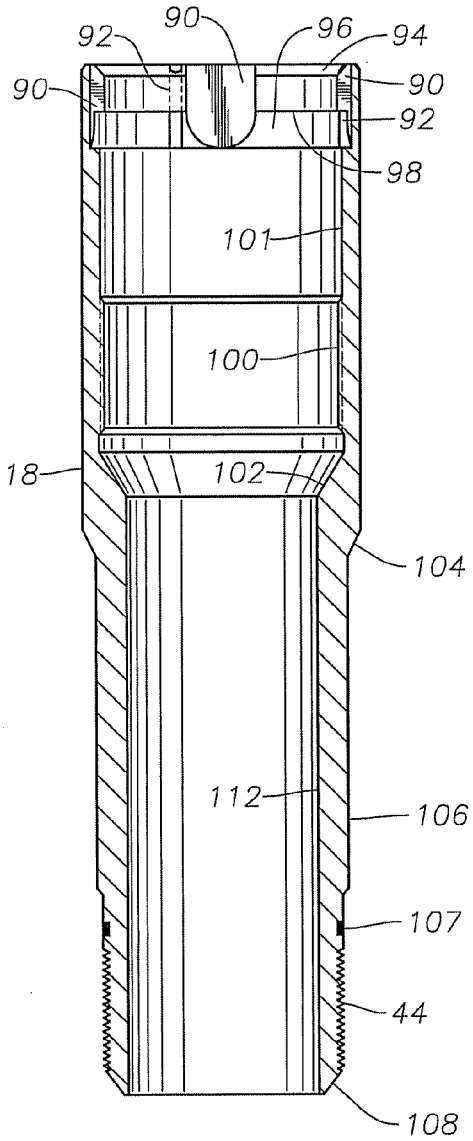
FIG. 3A is a sectional view of the isolation sleeve from FIG. 3, in accordance with one embodiment of the invention.
Figure 3B:
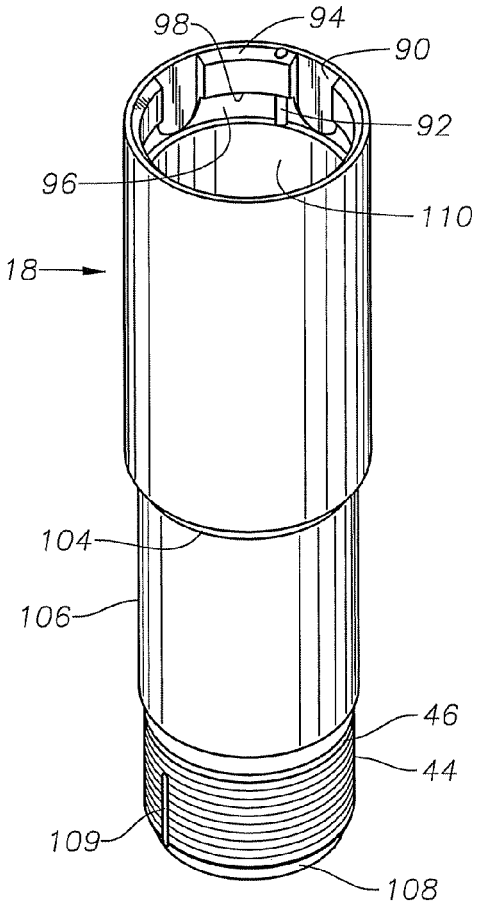
FIG. 3B is an isometric view of the isolation sleeve from FIG. 3, in accordance with one embodiment of the invention.

FIGS. 3-3B illustrate an embodiment of the isolation sleeve 18 in more detail. To facilitate installation and retrieval with conventional running tools, axially extending slots 90 are formed on an interior of the upper end of the isolation sleeve 18. Slots 90 extend downward from the rim of isolation sleeve 18. In this embodiment, the lower ends of slots 90 can have a rounded periphery as shown in FIG. 3A. A number of slots 90 are spaced evenly apart from each other circumferentially around isolation sleeve 18. A pin 92 can be inserted axially through a passage formed in an upper circumferential shoulder 94 at an end of the sleeve and adjacent to each slot 90. A circumferential groove 96 is formed on the same interior end as where the slots 90 are formed and creates an upward facing lower shoulder or lip on which a lower end of each pin 92 can be supported as well as a downward facing shoulder 98, as best shown in FIG. 3B. Downward facing shoulder 98 is spaced below upper shoulder 94, creating circumferentially extending bands between each of the slots 90. Alternatively, an indention corresponding with the diameter of the pin 92 can be formed on the upward facing lower shoulder of the circumferential groove 96 to receive a portion of the pin 92. Alternatively, a protrusion can be machined in the circumferential groove next to each slot 90 instead of utilizing a pin 92. Circumferential groove 96 is formed at a point within the sleeve 18 corresponding to lower ends of the slots 90. In this embodiment, the circumferential extent of upper shoulder 94 is interrupted by the slots 90. The circumferential groove 96 and downward facing shoulder 98 formed by it allows a conventional running tool to engage the sleeve 18, and the pin 92 provides a reaction point for the running tool to either thread or unthread the isolation sleeve 18. Each pin 92 is located between two of the slots 90 but closer to one of the slots 90 than the other. A running tool 114 will be described further below.

Continuing to refer to FIGS. 3A and 3B, in this embodiment the isolation sleeve 18 can have a threaded inner surface 100 below the circumferential groove 96. Threaded inner surface 100 extends upward a selected distance from a tapered internal shoulder 102. The threaded inner surface 100 allows additional components to be installed within the sleeve 18. A sealing area 101 can also be formed from below the circumferential groove 96 to threaded inner surface 100. The bore portion 112 below tapered shoulder 102 may be smaller and unthreaded. Further, the bore portion 112, in this embodiment, has a smaller diameter than an upper bore portion 110. Likewise, the outer diameter of the isolation sleeve 18 may reduce at an external tapered shoulder 104 down to a smaller lower outer diameter surface 106 to correspond with the internal profile of the tubing head 10. Lower outer surface 106 of sleeve 18 is slightly larger in diameter than the threaded outer surface 44 approximately below that threadingly engages the threaded profile 42 of the packoff bushing 14 during installation. In this example, external shoulder 104 is located below internal shoulder 102. The isolation sleeve 18 is sealed against packoff bushing 14 (FIG. 1) by seal 107 when isolation sleeve 18 is installed. A bevel 108 may be formed at the lower end of the isolation sleeve 18 for support by a corresponding bevel formed on the packoff bushing 14. Further, a slot 109 may be formed on the outer portion of the threaded outer surface 44 which allows pressure to be released to thereby facilitate removal of isolation sleeve 18.

Figure 4:
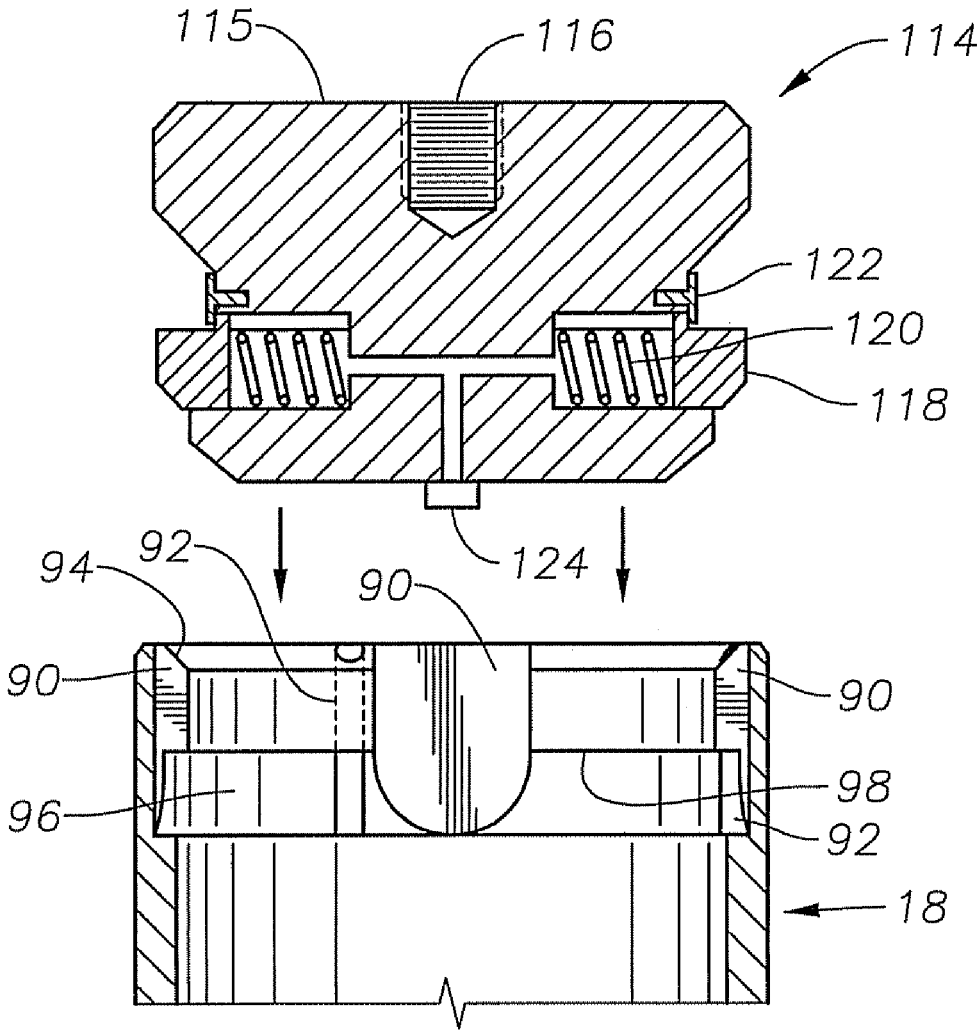
FIGS. 4-6 show an isolation sleeve sequentially being engaged by a running tool, in accordance with one embodiment of the invention.
Figure 5:
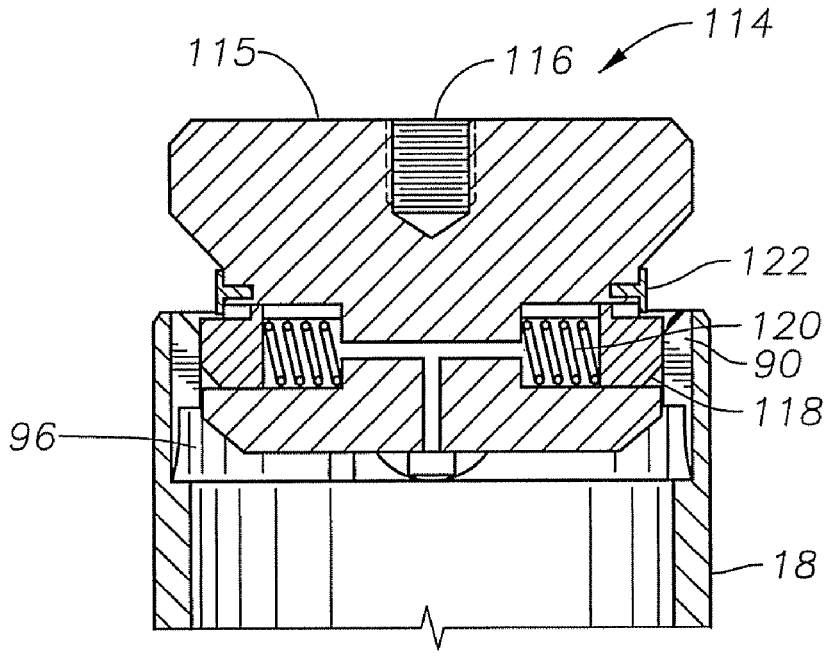
Figure 6:
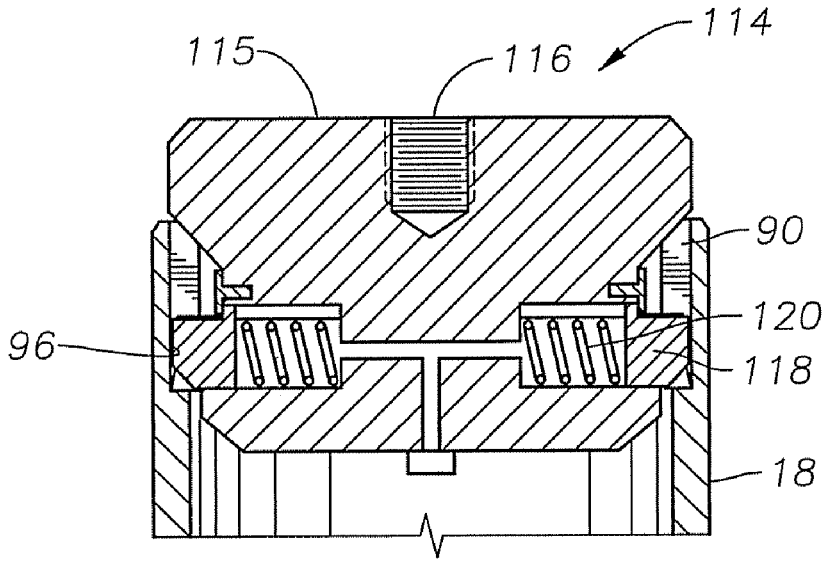

During installation or retrieval of the isolation sleeve 18 shown in FIGS. 3-3B, a conventional running/retrieval tool 114 as shown in FIGS. 4-6 can be used to make up/install the isolation sleeve 18 in the tubing head 10 (FIG. 1). Referring to FIG. 4, the tool 114 can comprise a body 115, a threaded stem engagement pocket 116 to allow running by a pipe string (not shown), and outward biased lugs 118 with springs 120 located within recesses in the body 115. Lugs 118 are spaced circumferentially around body 115 at the same spacing as slots 90. Each lug 118 has a circumferential width that is less than the circumferential width of each slot 90. The protruding end of each lug 118 may have a bevel on its lower end and a 90 degree corner on its upper end. Stops 122 screwed into the body 115 limit the outward movement of lugs 118 from body 115. The tool 114 can have a grease port 124 to maintain the springs 120 and lugs 118 lubricated.

To engage the isolation sleeve 18 with the tool 114 for either installation or retrieval, the tool 114 can be moved toward the end of the isolation sleeve 18 with the formed slots 90 as shown in FIG. 4. The orientation of the tool 114 as it moves toward the isolation sleeve 18 is not critical. In this embodiment, the lugs 118 on the tool 114 retract and load the springs 120 when the lugs 118 make contact with the shoulder 94 on the isolation sleeve 18, as shown in FIG. 5. During insertion of body 115, lugs 118 need not be aligned with slots 90 in isolation sleeve 18. As the tool 114 continues to move into the bore of the isolation sleeve 18 and the lugs 118 reach the circumferential groove 96, the springs 120 force the lugs 118 outward into the circumferential groove 96, as shown in FIG. 6. Upper shoulder 98 formed by the groove 96 prevents the tool 114 from coming out of the isolation sleeve 18 as long as lugs 118 are not aligned with slots 90.

Once the lugs 118 on tool 114 are engaged within the circumferential groove 96 formed within isolation sleeve 18 and the externally threaded profile 44 of the isolation sleeve 18 is positioned adjacent to the correspondingly threaded bore 42 of the packoff bushing 14, in this example, the tool 114 may then be rotated counterclockwise until the lugs 118 come into contact with the pins 92 (FIGS. 3-3B). The pins 92 provide a reaction point to transfer torque from the tool to the isolation sleeve 18, causing the sleeve 18 to rotate. In this embodiment, as the isolation sleeve 18 is rotated counterclockwise, the externally threaded profile 44 of the isolation sleeve 18 is threaded into engagement with the corresponding threaded bore 42 of the packoff bushing 42 until the isolation sleeve 18 is installed as described earlier in FIG. 1. When lugs 118 contact pins 92, they will be positioned within slots 90. Because the lugs 118 are aligned with the slots 90 on the interior of the isolation sleeve 18 during installation, the tool 114 can be removed from engagement with the isolation sleeve 18 simply by pulling up by the string (not shown) connected to the stem pocket 116. After installation, the upper end of isolation sleeve 18 may protrude a short distance above the upper side of DSA 60.

To retrieve the isolation sleeve 18 from tubing head 10 in this embodiment, the engaged tool 114 is rotated clockwise until the lugs 118 come into contact with the pins 92 (FIGS. 3-3B). Once again, the pins 92 provide a reaction point to transfer torque from the tool to the isolation sleeve 18, however, the reaction point on the pin 92 during retrieval is on a side of the pin 92 opposite that during installation. The torque transferred to the isolation sleeve 18 through the pin 92 causes the sleeve 18 to rotate and unthread from engagement with the threaded bore 42 of the packoff bushing 14. The upper shoulder 98 formed by the circumferential groove 96 prevents the lugs 118 from sliding out of engagement with the sleeve 18 as it is unthreaded from the packoff bushing 14. The direction of rotation for retrieval is preferably opposite that of installation, thus it would be clockwise. Thus each lug 118 will be contacting a different pin 92 than during installation. The different pin 92 places each lug 118 under part of downward facing shoulder 98 rather than within one of the slots 90. Consequently, once the isolation sleeve 18 is unthreaded from packoff bushing 14, the operator can simply pull upward on tool body 115.

Figure 8:
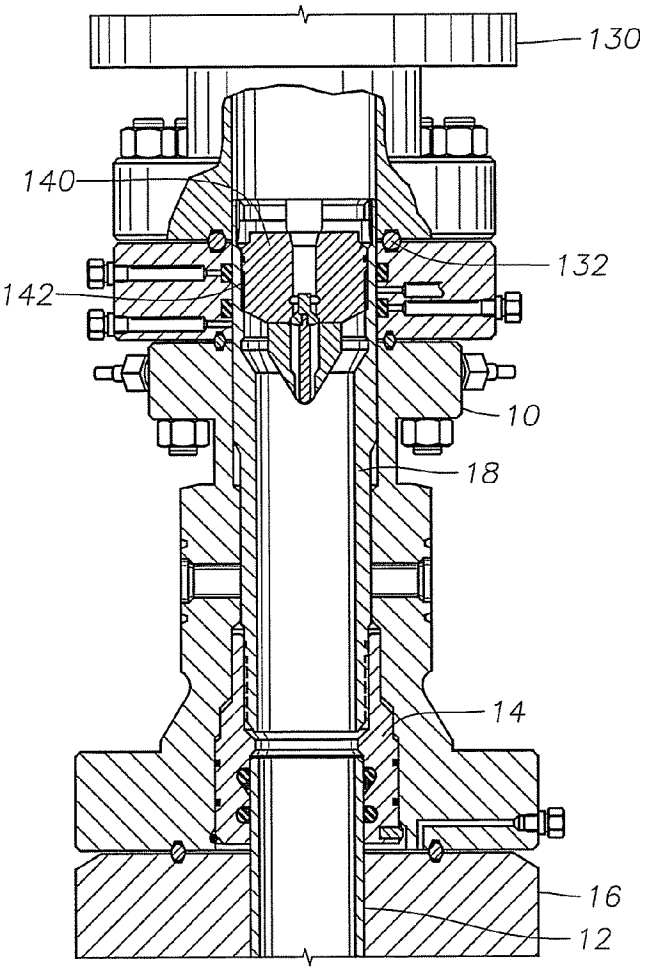
FIG. 8 is a sectional view of an isolation sleeve installed within a tubing head with a backpressure valve installed within, in accordance with one embodiment of the invention.
Figure 7:
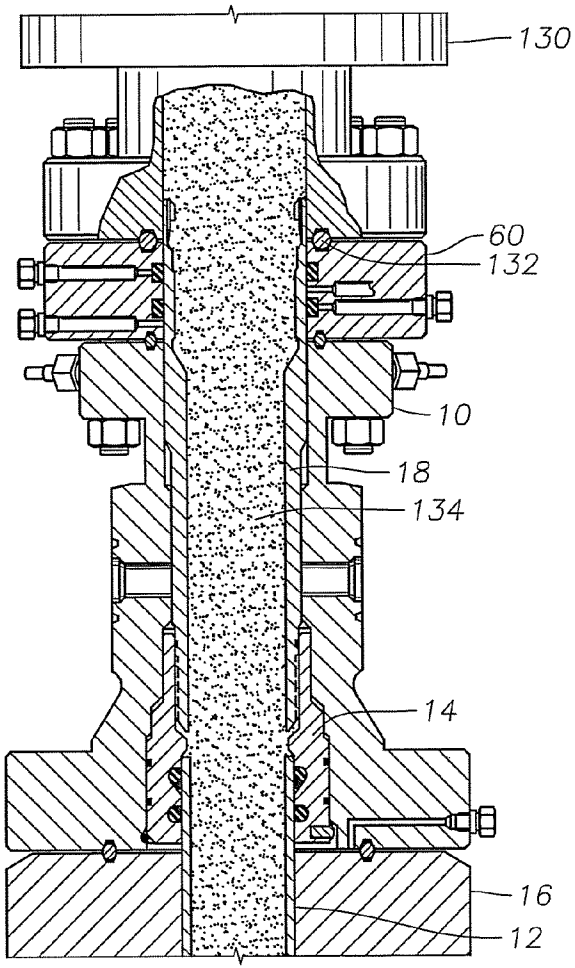
FIG. 7 is a sectional view of an isolation sleeve installed within a tubing head with frac media running within, in accordance with one embodiment of the invention.

Once the isolation sleeve 18 is installed within the tubing head 10, a frac valve 130, partially shown in FIG. 7, can be fastened to the DSA 60. The surfaces between the flange of the frac valve 130 and the DSA 60 can be sealed with a gasket 132. The frac valve 130 provides control of the flow of frac media or fluid 134 that is typically pumped into the well from trucks. Preferably, the inner diameter of the bore of frac valve 130 is larger than the outer diameter of isolation sleeve 18, allowing isolation sleeve 18 to be installed and retrieved through the bore of frace valve 130. Pressure control equipment, such as a lubricator or snubbing equipment, could be mounted on frac valve 130 to allow insertion and retrieval of isolation sleeve 18 while the well is under pressure. During the frac operation, the isolation sleeve 18 effectively protects the tubing head 10 from the high pressures generated during frac operations. The isolation sleeve 18 further protects the interior surfaces of the tubing head 10 from the abrasive frac media 134. When the fracturing operation is complete, a pressure containment device such as a back pressure valve "BPV" 140 with a threaded profile 142 can be threaded into the threaded inner surface 100 (FIG. 3A) of isolation sleeve 18 as shown in FIG. 8. The BPV 140 can be installed and retrieved through the bore of frac valve 130 with a conventional tool similar to tool 114 used to install and retrieve the isolation sleeve 18. BPV 140 retains any pressure within the well once installed, allowing frac valve 130 to be removed.

Figure 10:
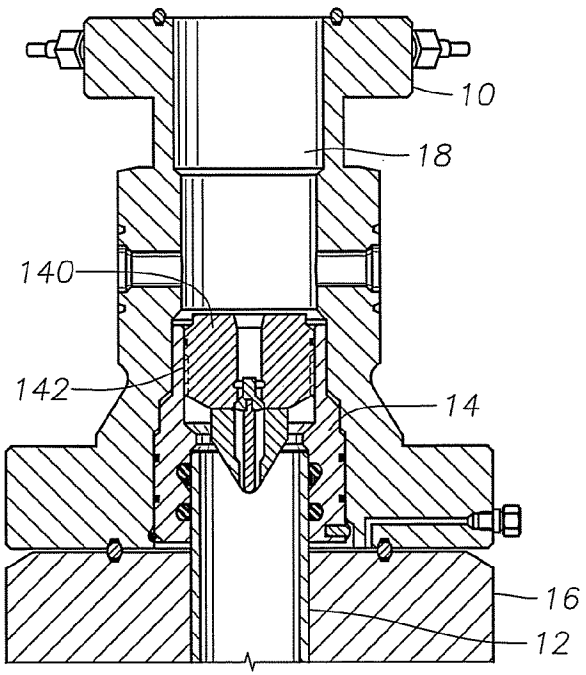
FIG. 10 is a sectional view of the tubing head with backpressure valve of FIG. 9 with the double studded adapter and frac valve removed, in accordance with one embodiment of the invention.
Figure 9:
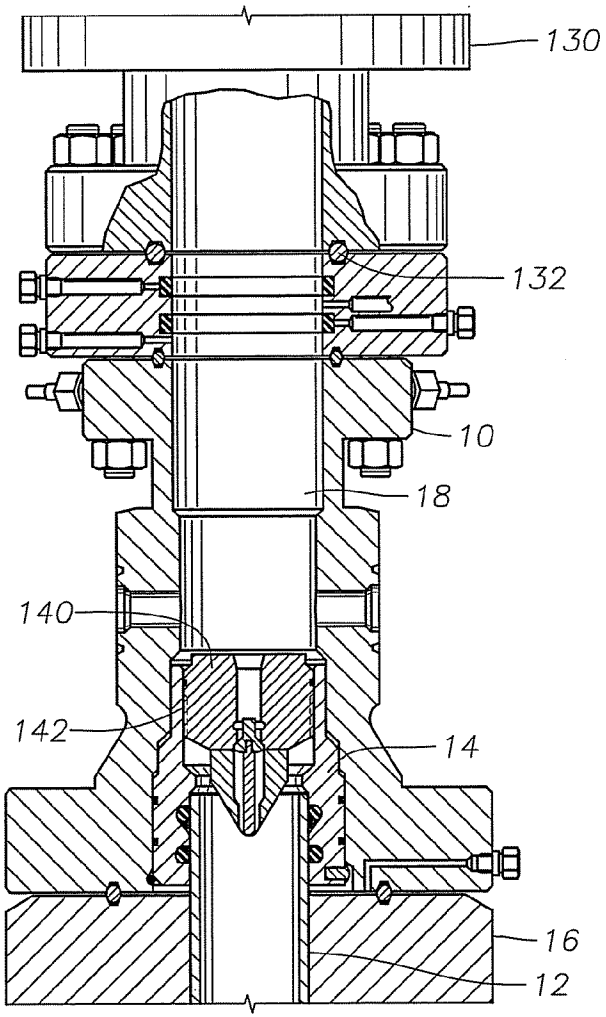
FIG. 9 is a sectional view of a tubing head with the isolation sleeve removed and a backpressure valve installed within a packoff bushing in the tubing head, in accordance with one embodiment of the invention.

Alternatively, the isolation sleeve 18 can be retrieved and the BPV 140 can be threaded into the threaded inner bore 42 (FIG. 1) of packoff bushing 14 as shown in FIG. 9. The packoff bushing 14 and isolation sleeve 18 are adapted with the same thread pattern so that the same BPV 140 can be threaded into both. In addition, the isolation sleeve 18 is threaded into the same threaded portion of the packoff bushing 14, as the BPV 140. Thus, during the fracturing operations, the isolation sleeve 18 protects the threads of the packoff 14 that are used to secure the BPV 140. The BPV 140 can also be retrieved through frac valve 130. The frac valve 130 and the DSA 60 could then be removed as shown in FIG. 10 to allow a snubbing unit (not shown) or workover BOP stack (not shown) to be rigged up to the tubing head 10. A test plug (not shown) could be installed at upper part of tubing head 10 after testing of the tubing head 10. The test plug and BPV 140 could be retrieved after testing.

While the invention has been shown in only a few of its forms, it should be apparent to those skilled in the art that it is not so limited but is susceptible to various changes without departing from the scope of the invention.

The invention claimed is:

1. A wellhead apparatus, comprising:

a wellhead member having a vertical bore for receiving an upper end of a string of conduit extending into a well, the bore of the wellhead member having a downward facing shoulder;

a packoff bushing within the bore of the wellhead member and having an external upward facing shoulder below the downward facing shoulder, preventing upward movement of the packoff bushing within the wellhead member, the bushing having a vertical bore adapted to closely receive the upper end of the conduit, the bore in the bushing having a set of threads;

an annular packoff seal within the bore of the bushing for sealing against an outer diameter of the conduit;

a sleeve carried within the bore of the wellhead member, the sleeve having a threaded outer profile that is secured to the threads in the bore of the bushing; and wherein the sleeve isolates the bore of the wellhead member from high pressure fluid injected into the sleeve, the sleeve has a passage with a circumferential groove formed in the passage adjacent an upper end of the sleeve for allowing engagement with a lug of a running tool, and the sleeve has a plurality of slots formed in the passage extending from the upper end of the sleeve toward the circumferential groove, a portion of each of the slots intersecting with the circumferential groove to allow disengagement of the lug on the running tool when aligned with the one of the slots; and a vertical shoulder located adjacent to each slot within the circumferential groove for providing a reaction point for the lug on the running tool to rotate the sleeve during installation and retrieval, the shoulder being positioned closer to one of the slots than an adjacent slot such that when engaged by the lug during rotation while installing the sleeve, the lug will be misaligned with any of the slots, and when engaged by the lug during rotation to retrieve the sleeve, the lug will be aligned with one of the slots.

2. The apparatus according to claim 1, further comprising a recess within the bore of the wellhead member corresponding to an outer profile of the packoff bushing for receiving a retaining member that retains the packoff bushing within the wellhead member.

3. The apparatus according to claim 1, further comprising an anti-rotation member between the wellhead member and the packoff bushing for preventing the packoff bushing from rotating during the installation or retrieval of the sleeve.

4. The apparatus according to claim 1, wherein the passage of the sleeve contains a set of threads;

wherein the apparatus further comprises a backpressure valve having a corresponding set of threads that secure to the threads in the passage of the sleeve; and wherein the threads in the passage of the sleeve have the same thread pattern as the set of threads in the bore of the packoff bushing to allow threading of the backpressure valve into either the packoff bushing or the sleeve.

5. The apparatus according to claim 1, wherein the packoff bushing has a passage containing a set of threads;

wherein the apparatus further comprises a backpressure valve having a corresponding set of threads that secure to the threads in the bore of the packoff bushing;

wherein the threads in the bore of the packoff bushing have the same thread pattern as a set of threads in a passage of the sleeve to allow threading of the backpressure valve into either the packoff bushing or the sleeve.

6. The apparatus according to claim 1, further comprising a profile formed at an upper end of the sleeve for releasable engagement by a running tool to support and rotate the sleeve.

7. The apparatus according to claim 1, further comprising:

an adapter mounted and sealed to an upper end of the wellhead member, the adapter having a bore that is coaxial with the bore of the wellhead member and receives an upper end of the sleeve, the adapter having an upper end adapted to support a fluid injection valve; and a seal in the bore of the adapter that seals against an outer diameter of the sleeve.

8. The apparatus according to claim 7, wherein the adapter comprising a flange that overlies a flange on an upper end of the wellhead member, the flange on the wellhead member containing bolt hole pattern; and wherein the apparatus further comprises a plurality of threaded studs rigidly mounted in the flange of the adapter, the studs extending downward from the flange of the adapter and through the bolt hole pattern of the wellhead member to secure the adapter to the wellhead member, the studs extending upward from the flange of the adapter for insertion into a bolt hole pattern of a fluid injection valve.

9. The apparatus according to claim 1, further comprising a seal on an outer diameter portion of the sleeve that sealingly engages the bore of the packoff bushing at a point above the packoff seal and the threads in the bore of the packoff bushing.

10. The apparatus according to claim 1, further comprising:

a stop shoulder located between the threads in the packoff bushing and the packoff seal that limits downward movement of the sleeve in the packoff bushing.

11. An apparatus for injecting fluid into a well, comprising:

a sleeve having a first end and having a second end to be positioned in a bore of a wellhead member, the sleeve having a threaded outer profile on the second end, the sleeve having a profile formed at the first end of the sleeve for releasable engagement by a running tool to support and rotate the sleeve, the sleeve having a passage containing a set of threads, the sleeve having a plurality of slots formed in the bore extending from the first end of the sleeve toward the profile formed on the first end, a portion of each of the slots intersecting with the profile formed at the first end of the sleeve to allow disengagement of a lug on the running tool when aligned with the one of the slots;

a pin is located adjacent to each slot for providing a reaction point for the lug on the running tool to rotate the sleeve during installation or retrieval, a passage adjacent to each slot for receiving the pin, the passage formed from the first end of the sleeve to the profile formed on the first end of the sleeve;

a packoff bushing located within the wellhead member, the packoff bushing having an outer profile approximately corresponding to an inner profile of the wellhead member having a bore and located at an upper end of a well, the packoff bushing having a partially threaded bore for threadingly engaging the threaded outer profile on the second end of the sleeve; and a backpressure valve having a corresponding set of threads for threadingly engaging either the threads in the passage of the sleeve or the threaded bore of the packoff bushing.

12. The apparatus according to claim 11, further comprising a recess within the inner profile of the wellhead member corresponding to the outer profile of the packoff bushing for receiving a snap ring that retains the packoff bushing within the wellhead member.

13. The apparatus according to claim 11, further comprising an anti-rotation member between the wellhead member and the packoff bushing for preventing the packoff bushing from rotating during the installation or retrieval of the sleeve.

14. The apparatus according to claim 11, wherein a seal on an outer diameter portion of the sleeve sealingly engages the bore of the packoff bushing at a point above the packoff seal within the bore of the bushing for sealing against an outer diameter of a conduit and the threads in the bore of the packoff bushing.

15. The apparatus according to claim 11, further comprising:

a stop shoulder located between the threads in the packoff bushing and the packoff seal that limits downward movement of the sleeve in the packoff bushing.

16. The apparatus according to claim 11, further comprising:

a downward facing shoulder located on the wellhead member that interferes with an upward facing shoulder located on the packoff bushing to limit the upward movement of the packoff bushing within the wellhead member.

* * * * *